US010928079B2

(12) United States Patent
Koike et al.

(10) Patent No.: US 10,928,079 B2
(45) Date of Patent: Feb. 23, 2021

(54) HEAT SOURCE UNIT

(71) Applicant: DAIKIN INDUSTRIES, LTD., Osaka (JP)

(72) Inventors: Fumiaki Koike, Osaka (JP); Shigeki Kamitani, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 63 days.

(21) Appl. No.: 16/095,006

(22) PCT Filed: Feb. 28, 2017

(86) PCT No.: PCT/JP2017/007844
§ 371 (c)(1),
(2) Date: Oct. 19, 2018

(87) PCT Pub. No.: WO2017/183311
PCT Pub. Date: Oct. 26, 2017

(65) Prior Publication Data

US 2019/0154279 A1 May 23, 2019

(30) Foreign Application Priority Data

Apr. 21, 2016 (JP) ..... JP2016-084984

(51) Int. Cl.
*F24F 1/10* (2011.01)
*F24F 1/22* (2011.01)
(Continued)

(52) U.S. Cl.
CPC ..... *F24F 1/10* (2013.01); *F24F 1/22* (2013.01); *F24F 1/30* (2013.01); *F24F 1/56* (2013.01); *F24F 13/20* (2013.01); *F25B 43/02* (2013.01)

(58) Field of Classification Search
CPC ..... F24F 1/10; F24F 1/30; F24F 13/20; F24F 1/22; F24F 1/56; F24F 1/16; F24F 1/46; F24F 1/38; F24F 1/50; F24F 1/24
See application file for complete search history.

(56) References Cited

U.S. PATENT DOCUMENTS 10,359,211 B2 * 7/2019 Mori ..... F24F 13/24
2002/0134099 A1 * 9/2002 Mochizuki ..... F24F 13/222 62/285
(Continued)

FOREIGN PATENT DOCUMENTS

CN 102141272 A 8/2011
EP 2354683 A2 * 8/2011 ..... F24F 1/16
(Continued)

OTHER PUBLICATIONS

Notification of Transmittal of Translation of the International Preliminary Report on Patentability for International Application No. PCT/JP2017/007844 dated Nov. 1, 2018 (1 page).
(Continued)

*Primary Examiner* — Kun Kai Ma
(74) *Attorney, Agent, or Firm* — Osha Bergman Watanabe & Burton LLP

(57) ABSTRACT

A heat source unit includes a compressor and an electrical component box both disposed inside a casing, where a bottom frame forming a bottom surface of the casing includes a first bottom frame on which the compressor is disposed and a second bottom frame that is adjacent to the first bottom frame. At least half of the electrical component box is placed above the second bottom frame.

6 Claims, 6 Drawing Sheets

(51) Int. Cl.

| | |
|---|---|
| ***F24F 1/56*** | (2011.01) |
| ***F24F 1/30*** | (2011.01) |
| ***F24F 13/20*** | (2006.01) |
| ***F25B 43/02*** | (2006.01) |

(56) References Cited

U.S. PATENT DOCUMENTS

| | | | | |
|---|---|---|---|---|
| 2007/0170827 | A1* | 7/2007 | Frenia | F24F 13/20 312/265.5 |
| 2009/0277205 | A1* | 11/2009 | Matsuda | F24F 1/38 62/259.1 |
| 2011/0127019 | A1* | 6/2011 | Abastari | F24F 13/08 165/121 |
| 2014/0224457 | A1 | 8/2014 | Suzuki et al. | |
| 2014/0298844 | A1* | 10/2014 | Luo | F24F 1/36 62/275 |
| 2014/0338384 | A1* | 11/2014 | Koike | F24F 1/36 62/285 |
| 2016/0076779 | A1* | 3/2016 | Lee | F24F 1/10 62/508 |
| 2016/0178248 | A1* | 6/2016 | Lim | F25B 13/00 62/498 |
| 2016/0178290 | A1* | 6/2016 | Lim | F28F 9/001 165/121 |
| 2017/0016636 | A1* | 1/2017 | Koo | F24F 1/50 |
| 2018/0274799 | A1* | 9/2018 | Morishita | F24F 1/50 |
| 2019/0338985 | A1* | 11/2019 | Koike | F24F 1/56 |

FOREIGN PATENT DOCUMENTS

| | | | | |
|---|---|---|---|---|
| EP | 2354683 | A2 | 8/2011 | |
| EP | 2767766 | A1 | 8/2014 | |
| JP | 2011-158137 | A | 8/2011 | |
| JP | 2013-83422 | A | 5/2013 | |
| JP | 2013-194960 | A | 9/2013 | |
| JP | 2014-98509 | A | 5/2014 | |
| JP | 2015-152241 | A | 8/2015 | |
| JP | 2016-38175 | A | 3/2016 | |
| JP | 6277523 | B2 * | 2/2018 | |
| WO | WO-2005031219 | A1 * | 4/2005 | F24F 1/24 |
| WO | 2018061426 | A1 | 4/2018 | |

OTHER PUBLICATIONS

International Preliminary Report on Patentability issued in corresponding International Application No. PCT/JP2017/007844 dated Oct. 23, 2018 (7 pages).

International Search Report issued in corresponding International Application No. PCT/JP2017/007844 dated May 30, 2017, with translation (5 pages).

Extended European Search Report issued in corresponding European Application No. 17785656.4; dated Apr. 1, 2019 (7 pages).

* cited by examiner

HEAT SOURCE UNIT

BACKGROUND

The present invention relates to a heat source unit, and particularly a heat source unit where a compressor and an electrical component box are provided inside a casing.

Conventionally, there is an air conditioning system configured as a result of a heat source unit and a utilization unit being connected by pipes. In the heat source unit configuring this kind of air conditioning system, a compressor and an electrical component box are provided inside a casing, such as described in patent document 1 (JP-A No. 2011-158137). Here, a bottom frame forming a bottom surface of the casing has a structure divided in the front and rear direction. Additionally, the compressor is provided on the front-surface-side bottom frame among the bottom frames divided in the front and rear direction, and the electrical component box is placed above the compressor.

In the conventional heat source unit, as described above, the bottom frame with the divided structure is employed, and the compressor and the electrical component box are placed in a space formed by the front-surface-side bottom frame configuring the portion on the front surface side of the casing. This placement may ensure the maintainability of the compressor and the electrical component box.

However, with this placement, both the compressor and the electrical component box come to occupy most of the space formed by the front-surface-side bottom frame, and the positional relationship between the compressor and the electrical component box also becomes limited to the positional relationship where the electrical component box is placed above the compressor.

For this reason, there ends up being less freedom in the placement of the compressor and the electrical component box, and there is the concern that design changes and so forth will not be able to be flexibly accommodated.

SUMMARY

One or more embodiments of the present invention may make it possible, in a heat source unit where a compressor and an electrical component box are provided inside a casing, both to achieve greater freedom in the placement of the compressor and the electrical component box and to ensure maintainability.

In a heat source unit according to one or more embodiments, a compressor and an electrical component box are provided inside a casing. Additionally, here, a bottom frame forming a bottom surface of the casing has a first bottom frame on which the compressor is provided and a second bottom frame that is adjacent to the first bottom frame. At least half of the electrical component box is placed above the second bottom frame.

Here, the bottom frame is divided in two, and the compressor is provided on one bottom frame (the first bottom frame) and most of the electrical component box is placed above the other bottom frame (the second bottom frame), so compared to the conventional case where the compressor and the electrical component box are placed on the same bottom frame, it becomes easier to place the compressor and the electrical component box, and interference between the compressor and the electrical component box can also be prevented.

Because of this, here, it is possible both to achieve greater freedom in the placement of the compressor and the electrical component box and to ensure maintainability.

In a heat source unit according to one or more embodiments, the first bottom frame and the second bottom frame are placed side by side in the right and left direction when the casing is viewed from its front surface side.

Here, the compressor and the electrical component box are placed side by side to the left and right of each other, so the maintainability of the compressor and the electrical component box can be reliably ensured.

In a heat source unit according to one or more embodiments, the electrical component box has the shape of a vertically long box in a state in which it is provided inside the casing.

In a case where the electrical component box has the shape of a vertically long box, in contrast to the conventional heat source unit, it is difficult to place the electrical component box in the space above the compressor.

However, here, as described above, the compressor is provided on the first bottom frame and most of the electrical component box is placed above the second bottom frame, so compared to the conventional case where the compressor and the electrical component box are placed on the same bottom frame, it becomes easier to prevent interference between the compressor and the electrical component box. Furthermore, in a case where the compressor and the electrical component box are placed side by side to the left and right of each other, giving the electrical component box the shape of a vertically long box can reduce the right and left direction width of the electrical component box and can also contribute to making the casing compact.

In a heat source unit according to one or more embodiments, the electrical component box is provided on the second bottom frame.

Here, at least half of the electrical component box can be easily placed above the second bottom frame. Furthermore, when assembling the heat source unit, it becomes possible to assemble the heat source unit by providing the compressor on the first bottom frame, separately providing the electrical component box on the second bottom frame, and thereafter uniting the two bottom frames, and because of this, the assemblability of the heat source unit can be improved.

In a heat source unit according to one or more embodiments, provided on the first bottom frame are an oil separator that separates refrigerating machine oil from refrigerant after the refrigerant has been discharged from the compressor and a refrigerant vessel that temporarily accumulates the refrigerant.

In the conventional case where the compressor and the electrical component box are placed on the same bottom frame, both the compressor and the electrical component box come to occupy most of the space formed by the bottom frame, so many of the refrigerant circuit constituent parts other than the compressor, such as the oil separator and the refrigerant vessel, must be provided on the side of the bottom frame where the compressor and the electrical component box are not placed. When this is done, a certain degree of strength also becomes required on the side of the bottom frame where the compressor and the electrical component box are not placed.

Therefore, here, as described above, the oil separator and the refrigerant vessel are provided on the first bottom frame on which the compressor is provided. For this reason, the strength required of the first bottom frame can be increased and the strength required of the second bottom frame can be reduced.

Because of this, here, the plate thickness of the first bottom frame can be increased to enhance strength, and the plate thickness of the second bottom frame can be reduced.

In a heat source unit according to one or more embodiments, the first bottom frame and the second bottom frame are corrugated plate-like members in which ridge portions and furrow portions extending across the front and rear direction of the casing are formed.

Here, the first bottom frame and the second bottom frame are configured to be corrugated plate-like members, so high-strength bottom frames can be obtained. Moreover, here, the ridge portions and the furrow portions of the corrugated plate-like first bottom frame and second bottom frame are formed extending across the front and rear direction of the casing, so this is suited for placing the first bottom frame and the second bottom frame side by side to the left and right of each other when the casing is viewed from the front surface side.

DETAILED DESCRIPTION

Embodiments of a heat source unit pertaining to the invention, and example modifications thereof, will be described below on the basis of the drawings. It will be noted that the specific configurations of the heat source unit pertaining to the invention are not limited to those in the following embodiments and the example modifications thereof and can be changed in a range that does not depart from the spirit of the invention.

(1) Configuration of Air Conditioning System

Figure 1:
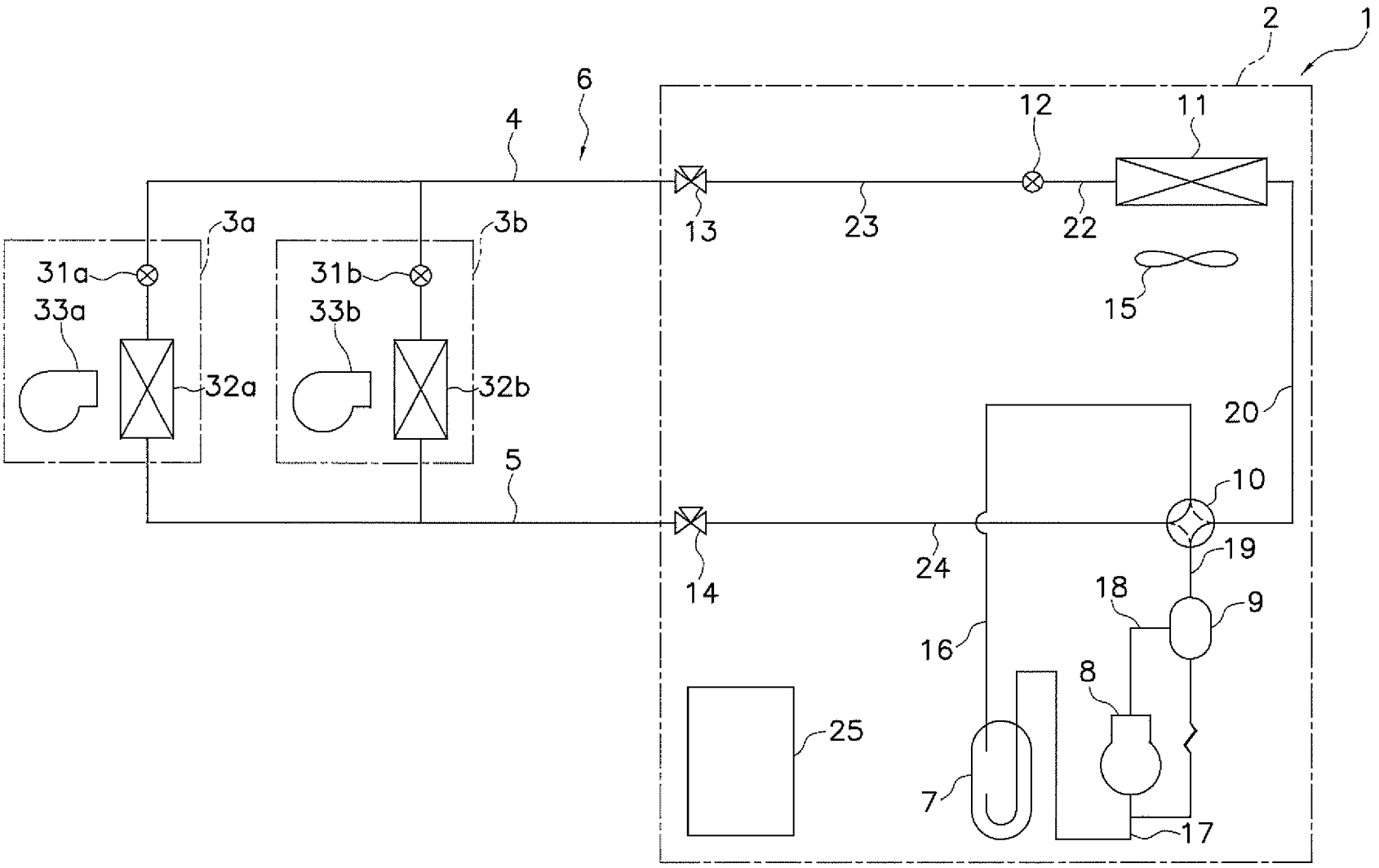
FIG. 1 is a general configuration diagram of an air conditioning system in which a heat source unit according to one or more embodiments of the invention is employed.

FIG. 1 is a general configuration diagram of an air conditioning system 1 in which a heat source unit 2 pertaining to one or more embodiments of the invention is employed.

The air conditioning system 1 is a system that can perform cooling and heating of rooms in a building, for example, by performing a vapor compression refrigeration cycle. The air conditioning system 1 is configured as a result of mainly the heat source unit 2 and utilization units 3*a* and 3*b* being connected. Here, the heat source unit 2 and the utilization units 3*a* and 3*b* are connected via a liquid refrigerant communication pipe 4 and a gas refrigerant communication pipe 5. That is, a vapor compression refrigerant circuit 6 of the air conditioning system 1 is configured as a result of the heat source unit 2 and the utilization units 3*a* and 3*b* being connected via the refrigerant communication pipes 4 and 5.

The heat source unit 2 is installed outdoors (e.g., on the roof of the building or adjacent to a wall surface of the building) and configures part of the refrigerant circuit 6. The heat source unit 2 mainly has an accumulator 7, a compressor 8, an oil separator 9, a four-port switching valve 10, a heat source-side heat exchanger 11, a heat source-side expansion valve 12, a liquid-side stop valve 13, a gas-side stop valve 14, a heat source-side fan 15, and an electrical component box 25. The devices and valves are connected to each other by refrigerant pipes 16 to 24.

The utilization units 3*a* and 3*b* are installed in rooms (e.g., living rooms or spaces on the reverse sides of ceilings) and configure part of the refrigerant circuit 6. The utilization unit 3*a* mainly has a utilization-side expansion valve 31*a*, a utilization-side heat exchanger 32*a*, and a utilization-side fan 33*a*. The utilization unit 3*b* mainly has a utilization-side expansion valve 31*b*, a utilization-side heat exchanger 32*b*, and a utilization-side fan 33*b*.

The refrigerant communication pipes 4 and 5 are refrigerant pipes constructed on site when installing the air conditioning system 1 in an installation location such as a building. One end of the liquid refrigerant communication pipe 4 is connected to the liquid-side stop valve 13 of the heat source unit 2, and the other end of the liquid refrigerant communication pipe 4 is connected to liquid-side ends of the utilization-side expansion valves 31*a* and 31*b* of the utilization units 3*a* and 3*b*. One end of the gas refrigerant communication pipe 5 is connected to the gas-side stop valve 14 of the heat source unit 2, and the other end of the gas refrigerant communication pipe 5 is connected to gas-side ends of the utilization-side heat exchangers 32*a* and 32*b* of the utilization units 3*a* and 3*b*.

(2) Configuration of Heat Source Unit

Figure 2:
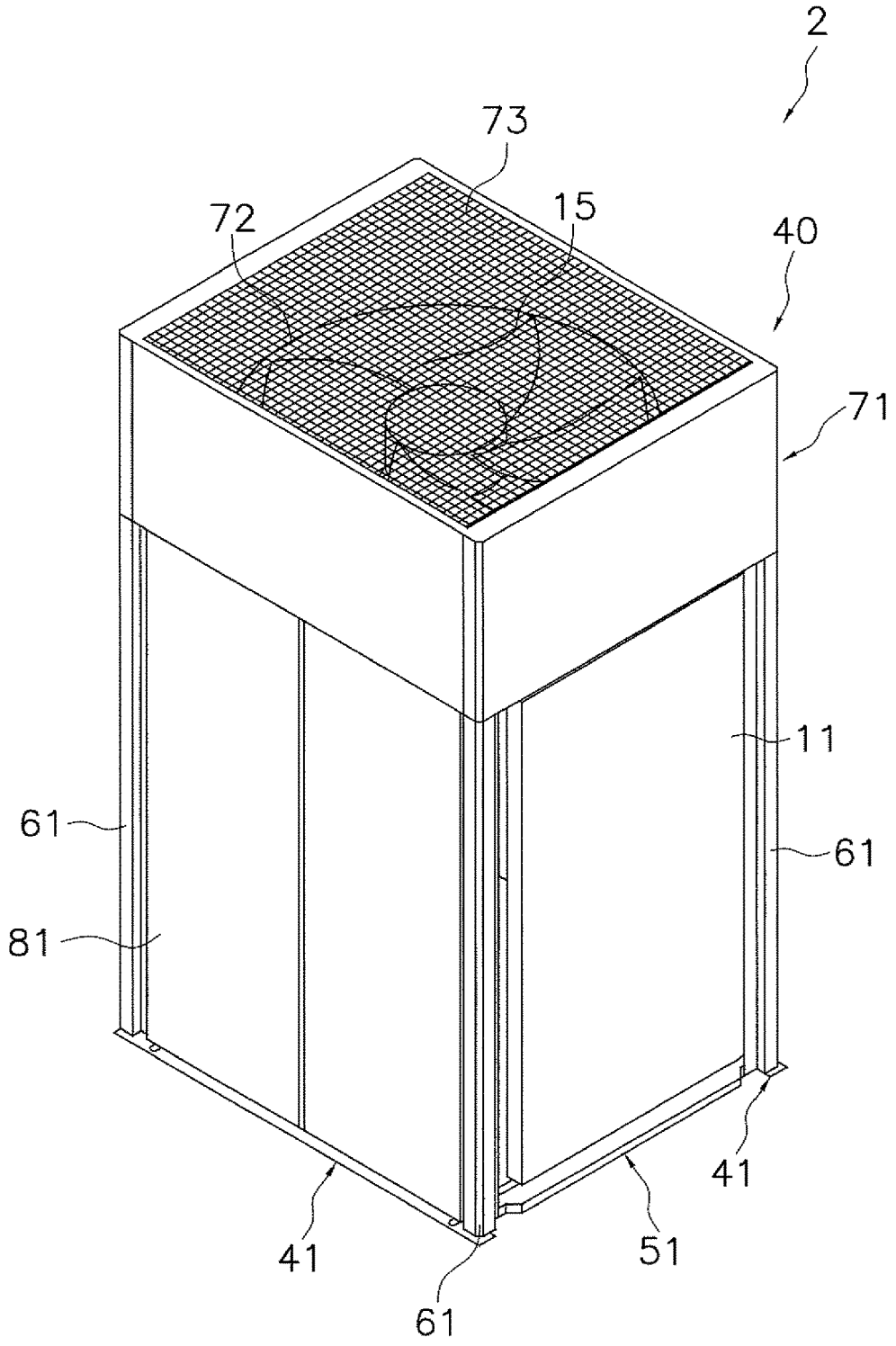
FIG. 2 is an external perspective view of the heat source unit according to one or more embodiments.
Figure 3:
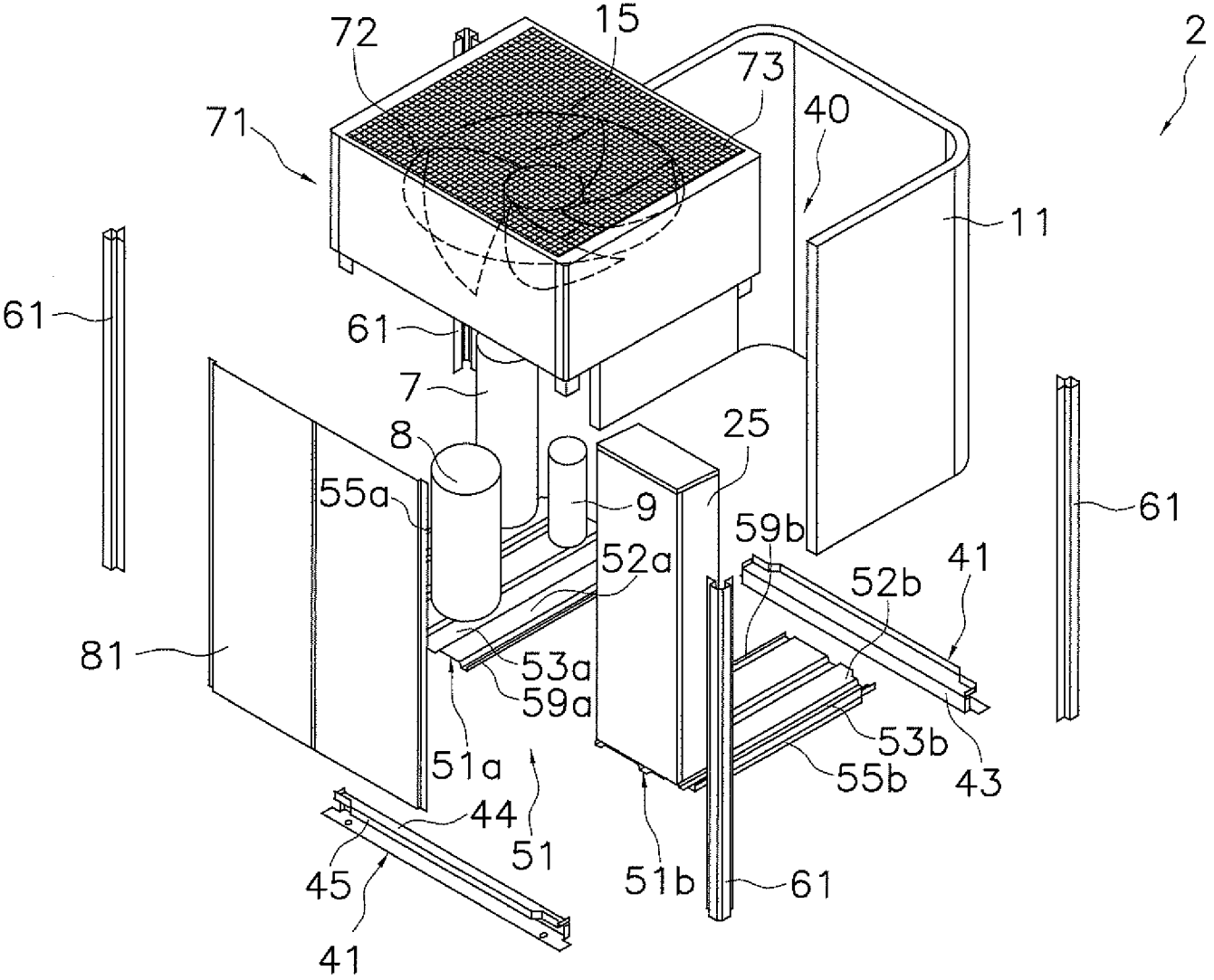
FIG. 3 is an exploded perspective view of the heat source unit (showing only the general shapes of an accumulator, a compressor, an oil separator, a heat source-side heat exchanger, and an electrical component box) according to one or more embodiments.
Figure 4:
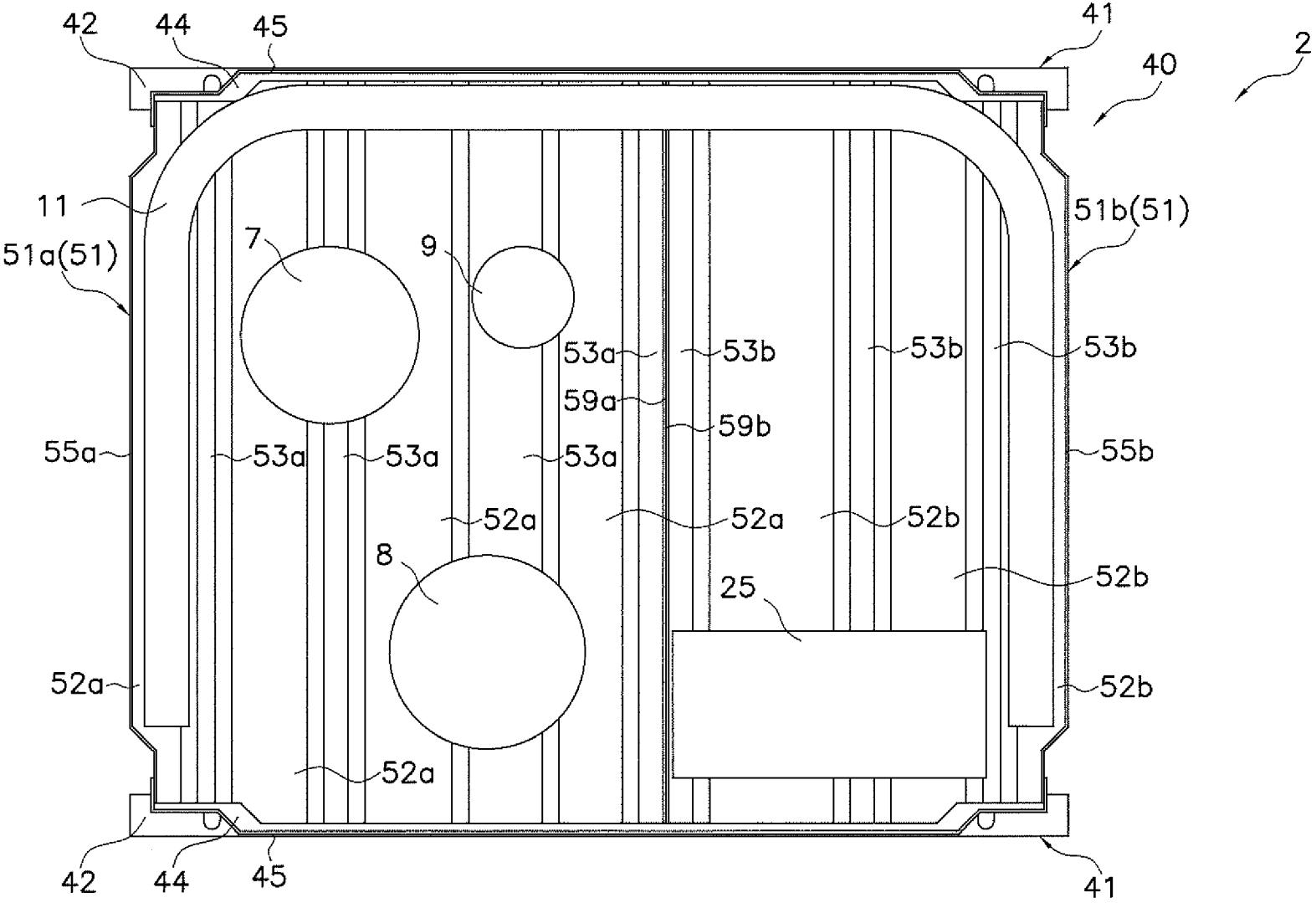
FIG. 4 is a plan view showing a bottom frame and mounting feet (showing only the general shapes of the accumulator, the compressor, the oil separator, the heat source-side heat exchanger, and the electrical component box) according to one or more embodiments.

FIG. 2 is an external perspective view of the heat source unit 2. FIG. 3 is an exploded perspective view of the heat source unit 2 (showing only the general shapes of the accumulator 7, the compressor 8, the oil separator 9, the heat source-side heat exchanger 11, and the electrical component box 25). FIG. 4 is a plan view showing a bottom frame 51 and mounting feet 41 (showing only the general shapes of the accumulator 7, the compressor 8, the oil separator 9, the heat source-side heat exchanger 11, and the electrical component box 25).

<Overall Structure>

The heat source unit 2 has what is called an upward-blowing structure that takes air into a casing 40 from below and blows the air out to the outside of the casing 40 from above. The heat source unit 2 mainly has the casing 40, which is shaped substantially like a rectangular parallelepiped box, the heat source-side fan 15, refrigerant circuit constituent parts that configure part of the refrigerant circuit 6 and include the devices 7, 8, 9, and 11 such as the compressor and the heat source-side heat exchanger, the valves 10 and 12 to 14 such as the four-port switching valve and the heat source-side expansion valve, and the refrigerant pipes 16 to 24, and the electrical component box 25. It will be noted that in the following description, unless otherwise specified, "upper," "lower," "left," "right," "front," "rear," "front surface," and "back surface" will mean directions in a case where the heat source unit 2 shown in FIG. 2 is seen from the front (diagonally forward and to the left in the drawing).

The casing 40 mainly has a bottom frame 51 that bridges a pair of mounting feet 41 extending in the right and left direction, struts 61 that extend in the vertical direction from corner portions of the bottom frame 51, a fan module 71 that is attached to the upper ends of the struts 61, and a front surface panel 81.

The bottom frame 51 forms a bottom surface of the casing 40, and the heat source-side heat exchanger 11 is provided on the bottom frame 51. Here, the heat source-side heat exchanger 11 is a heat exchanger that is substantially U-shaped as seen in a plan view and faces the back surface and both right and left side surfaces of the casing 40, and substantially forms the back surface and both right and left side surfaces of the casing 40.

The fan module 71 is provided on the upper side of the heat source-side heat exchanger 11 and forms a top surface of the casing 40 and sections of the front surface, the back surface, and both right and left side surfaces of the casing 40 on the upper side of the struts 61. Here, the fan module 71 is a composite body where the heat source-side fan 15 and a bell mouth 72 are housed in a substantially rectangular parallelepiped box whose upper surface and lower surface are open, and an air outlet grille 73 is provided in the opening in the upper surface.

The front surface panel 81 bridges the struts 61 on the front surface side and forms a front surface of the casing 40.

Also housed inside the casing 40 are refrigerant circuit constituent parts other than the heat source-side fan 15 and the heat source-side heat exchanger 11 (FIG. 3 and FIG. 4 show the accumulator 7, the compressor 8, and the oil separator 9) and the electrical component box 25. Here, the compressor 8 is a device that compresses refrigerant and is provided on the bottom frame 51. Furthermore, the accumulator 7 is a refrigerant vessel that temporarily accumulates the refrigerant before the refrigerant is sucked into the compressor 8, and the accumulator 7 is provided on the bottom frame 51. The oil separator 9 is a device that separates refrigerating machine oil from the refrigerant after the refrigerant has been discharged from the compressor 8, and the oil separator 9 is provided on the bottom frame 51. The electrical component box 25 is a composite body of electrical components for controlling devices, such as the compressor 8 and the heat source-side fan 15, and valves, and the electrical component box 25 is placed above the bottom frame 51.

<Detailed Structure (Including Plan for Placement of Compressor 8 and Electrical Component Box 25)>

The bottom frame 51 is a corrugated plate-like member in which ridge portions and furrow portions extending across the front and rear direction of the casing 40 are formed, and the bottom frame 51 has a first bottom frame 51*a* and a second bottom frame 51*b* that result from the bottom frame 51 being divided in two in the right and left direction. Here, the first bottom frame 51*a* configures the left portion of the bottom frame 51 when the casing 40 is viewed from the front surface side, and the first bottom frame 51*a* is a corrugated plate-like member in which ridge portions 52*a* and furrow portions 53*a* extending across the front and rear direction of the casing 40 are formed. The second bottom frame 51*b* configures the right portion of the bottom frame 51 when the casing 40 is viewed from the front surface side, and the second bottom frame 51*b* is a corrugated plate-like member in which ridge portions 52*b* and furrow portions 53*b* extending across the front and rear direction of the casing 40 are formed. The first bottom frame 51*a* and the second bottom frame 51*b* are placed side by side in the right and left direction when the casing 40 is viewed from the front surface side. The first bottom frame 51*a* and the second bottom frame 51*b* bridge the mounting feet 41. End portions of the first and second bottom frames 51*a* and 51*b* on sides (here, in the front and rear direction) where the ridge portions 52*a* and 52*b* and the furrow portions 53*a* and 53*b* can be seen are supported by the mounting feet 41. An outer wall portion 55*a* that extends upward beyond the ridge portions 52*a* and the furrow portions 53*a* is formed on the end portion of the first bottom frame 51*a* orthogonal (here, in the right and left direction) to the front and rear direction end portions of the first bottom frame 51*a* and on the side (here, the left side) distant from the second bottom frame 51*b*. A connecting wall portion 59*a* that borders the second bottom frame 51*b* is formed on the end portion of the first bottom frame 51*a* orthogonal (here, in the right and left direction) to the front and rear direction end portions of the first bottom frame 51*a* and on the side (here, the right side) close to the second bottom frame 51*b*. Furthermore, an outer wall portion 55*b* that extends upward beyond the ridge portions 52*b* and the furrow portions 53*b* is formed on the end portion of the second bottom frame 51*b* orthogonal (here, in the right and left direction) to the front and rear direction end portions of the second bottom frame 51*b* and on the side (here, the right side) distant from the first bottom frame 51*a*. A connecting wall portion 59*b* that borders the first bottom frame 51*a* is formed on the end portion of the second bottom frame 51*b* orthogonal (here, in the right and left direction) to the front and rear direction end portions of the second bottom frame 51*b* and on the side (here, the left side) close to the first bottom frame 51*a*. Additionally, in contrast to the right and left direction end portions of the first and second bottom frames 51*a* and 51*b*, outer wall portions are not formed on the front and rear direction end portions of the first and second bottom frames 51*a* and 51*b*, and so the shapes of the first and second bottom frames 51*a* and 51*b* are simplified.

Furthermore, here, the first bottom frame 51*a* and the second bottom frame 51*b* are configured to be corrugated plate-like members, so high-strength bottom frames 51*a* and 51*b* can be obtained. Moreover, here, the ridge portions 52*a* and 52*b* and the furrow portions 53*a* and 53*b* of the corrugated plate-like first bottom frame 51*a* and second bottom frame 51*b* are formed extending across the front and rear direction of the casing 40, so this is suited for placing the first bottom frame 51*a* and the second bottom frame 51*b* side by side to the left and right of each other when the casing 40 is viewed from the front surface side.

The mounting feet 41 are members that are substantially C-shaped as seen in a side view and extend in the right and left direction of the casing 40. The mounting feet 41 each mainly have an anchored portion 42 that becomes anchored to an installation surface, a vertical portion 43 that extends upward from an end portion of the anchored portion 42 on one side in the front and rear direction, and a support portion 44 that extends horizontally from the upper end portion of the vertical portion 43 toward the other side in the front and rear direction. The support portions 44 support the front and rear direction end portions of the first and second bottom frames 51*a* and 51*b* from below. Furthermore, the mounting feet 41 each have a wall portion 45 that extends upward from the end portion of the support portion 44 on the other side in the front and rear direction. The wall portions 45 are positioned on outer sides of the front and rear direction end portions of the first and second bottom frames 51*a* and 51*b*. That is, in the case of the mounting foot 41 placed on the front surface side of the casing 40, the wall portion 45 is positioned on the front side of the front and rear direction end portions of the first and second bottom frames 51*a* and 51*b*, and in the case of the mounting foot 41 placed on the back surface side of the casing 40, the wall portion 45 is positioned on the back surface side of the front and rear direction end portions of the first and second bottom frames 51*a* and 51*b*. Additionally, the wall portions 45 of the mounting feet 41 function as outer wall portions of the front and rear direction end portions of the first and second bottom frames 51*a* and 51*b*. That is, here, the wall portions 45 of the mounting feet 41 have the same function as the outer wall portions 55*a* and 55*b* of the right and left direction end portions of the first and second bottom frames 51*a* and 51*b*, while simplifying the shape of the first and second bottom frames 51*a* and 51*b*.

In the heat source unit 2 employing the bottom frame 51 with this divided structure, the compressor 8 and the electrical component box 25 are provided inside the casing 40, but at this time it is desired to make it possible both to achieve greater freedom in the placement of the compressor 8 and the electrical component box 25 and to ensure maintainability.

Therefore, here, as described above, the bottom frame 51 is divided in two (the first and second bottom frames 51*a* and 51*b*), and the compressor 8 is provided on one bottom frame (the first bottom frame 51*a*) and most (at least half) of the electrical component box 25 is placed above the other bottom frame (the second bottom frame 51*b*). Specifically, the compressor 8 is placed on the portion of the first bottom frame 51*a* near the front surface, and the electrical component box 25 is placed on the portion of the second bottom frame 51*b* near the front surface. Furthermore, here, all of the electrical component box 25 (i.e., the entire outline of the electrical component box 25 when the casing 40 is viewed from above) is placed above the second bottom frame 51*b*.

Additionally, by employing this structure, compared to the conventional case where the compressor and the electrical component box are placed on the same bottom frame, it becomes easier to place the compressor 8 and the electrical component box 25, and interference between the compressor 8 and the electrical component box 25 can also be prevented. Because of this, here, it is possible both to achieve greater freedom in the placement of the compressor 8 and the electrical component box 25 and to ensure maintainability. Furthermore, here, the compressor and the electrical component box are placed side by side to the left and right of each other, so the maintainability of the compressor 8 and the electrical component box 25 can be reliably ensured.

Furthermore, here, the electrical component box 25 has the shape of a vertically long box in a state in which it is provided inside the casing 40. Here, in a case where the electrical component box 25 has the shape of a vertically long box, in contrast to the conventional heat source unit, it is difficult to place the electrical component box 25 in the space above the compressor 8. However, here, as described above, the compressor 8 is provided on the first bottom frame 51*a* and most of the electrical component box 25 is placed above the second bottom frame 51*b*, so compared to the conventional case where the compressor and the electrical component box are placed on the same bottom frame, it becomes easier to prevent interference between the compressor 8 and the electrical component box 25. Furthermore, as described above, in a case where the compressor 8 and the electrical component box 25 are placed side by side to the left and right of each other, giving the electrical component box 25 the shape of a vertically long box can reduce the right and left direction width of the electrical component box 25 and can also contribute to making the casing 40 compact.

Furthermore, here, the electrical component box 25 is provided on the second bottom frame 51*b*. For this reason, here, at least half of the electrical component box 25 can be easily placed above the second bottom frame 51*b*. Furthermore, when assembling the heat source unit 2, it becomes possible to assemble the heat source unit 2 by providing the compressor 8 on the first bottom frame 51*a*, separately providing the electrical component box 25 on the second bottom frame 51*b*, and thereafter uniting the two bottom frames 51*a* and 51*b*, and because of this, the assemblability of the heat source unit 2 can be improved.

Furthermore, here, provided on the first bottom frame 51*a* are the oil separator 9 that separates the refrigerating machine oil from the refrigerant after the refrigerant has been discharged from the compressor 8 and the accumulator 7 serving as a refrigerant vessel that temporarily accumulates the refrigerant. Here, in the conventional case where the compressor and the electrical component box are placed on the same bottom frame, both the compressor and the electrical component box come to occupy most of the space formed by the bottom frame, so many of the refrigerant circuit constituent parts other than the compressor, such as the oil separator and the refrigerant vessel, must be provided on the side of the bottom frame where the compressor and the electrical component box are not placed. When this is done, a certain degree of strength also becomes required on the side of the bottom frame where the compressor and the electrical component box are not placed. However, here, as described above, the oil separator 9 and the accumulator 7 are provided on the first bottom frame 51*a* on which the compressor 8 is provided. For this reason, the strength required of the first bottom frame 51*a* can be increased and the strength required of the second bottom frame 51*b* can be reduced. Because of this, here, the plate thickness of the first bottom frame 51*a* can be increased to enhance strength, and the plate thickness of the second bottom frame 51*b* can be reduced. Furthermore, by increasing the plate thickness of the first bottom frame 51*a*, the propagation of operational vibrations of the compressor 8 is also reduced, so this can also contribute to improving vibration and noise performance.

(3) Example Modifications

<A>

Figure 5:
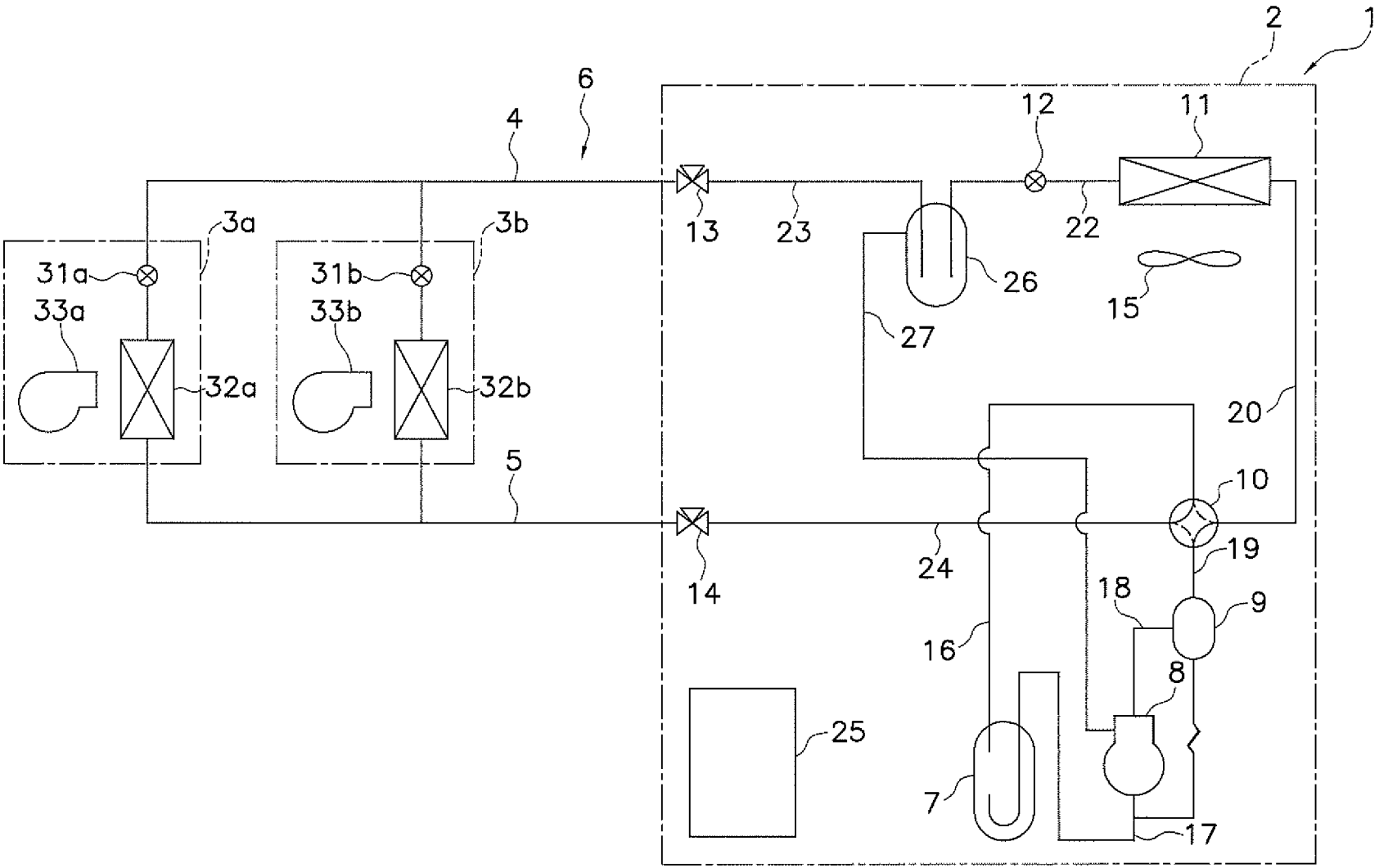
FIG. 5 is a general configuration diagram of the air conditioning system in which a heat source unit according to one or more embodiments of the invention is employed.

In the air conditioning system 1 of one or more embodiments (see FIG. 1), there are cases where one wants to make a change in or addition to the refrigerant circuit constituent parts configuring the refrigerant circuit 6 to add a function for enhancing performance or the like. For example, as shown in FIG. 5, there are cases where one connects a receiver 26 to the refrigerant pipe 23 inside the heat source unit 2 and connects a degassing pipe 27, which removes gas refrigerant from the upper portion of the receiver 26, to add the function of performing gas injection to the compressor 8.

Figure 6:
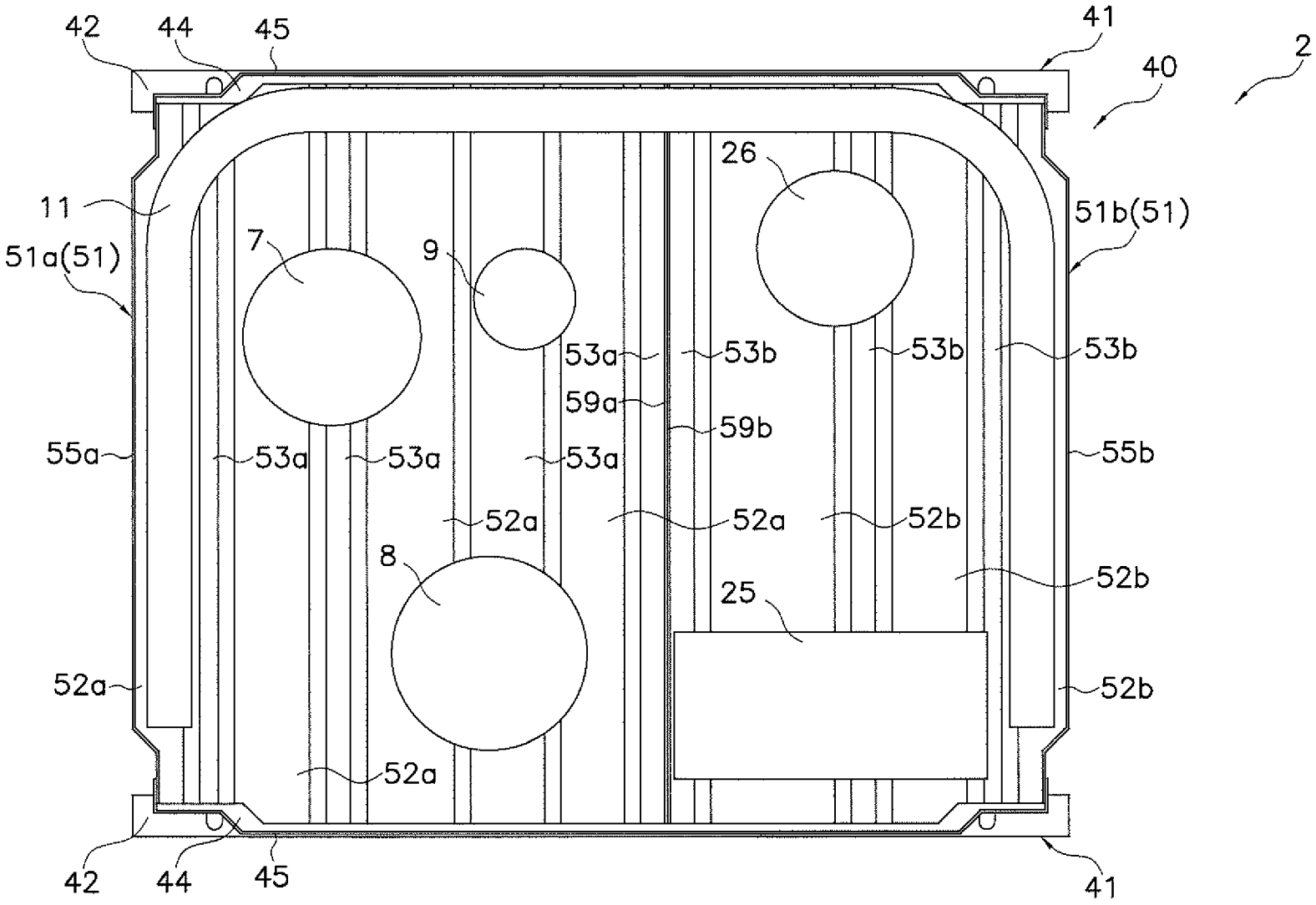
FIG. 6 is a plan view, corresponding to FIG. 4, showing the bottom frame and the mounting feet according to one or more embodiments.

With respect to such changing or adding of the refrigerant circuit constituent parts (here, mainly adding the receiver 26 and the degassing pipe 27), here, as shown in FIG. 6, the receiver 26 is provided on the second bottom frame 51*b*, the refrigerant pipe 23 (not shown in FIG. 6) is connected to the receiver 26, and the degassing pipe 27 (not shown in FIG. 6) is connected to the receiver 26 and the compressor 8.

In this way, here, the receiver 26 and the degassing pipe 27 are provided on the second bottom frame 51*b*, so the gas injection function can be added without changing the placement of the refrigerant circuit constituent parts such as the compressor 8 provided on the first bottom frame 51*a*. That is, here, design changes such as function additions can also be flexibly accommodated.

<B>

In the embodiments and example modification A, the first bottom frame 51*a* configures the left portion of the bottom surface of the casing 40 and the second bottom frame 51*b* configures the right portion of the bottom surface of the casing 40, but the first bottom frame 51*a* and the second bottom frame 51*b* are not limited to this and may also be switched in the right and left direction.

INDUSTRIAL APPLICABILITY

The present invention is widely applicable to a heat source unit where a compressor and an electrical component box are provided inside a casing.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

2 Heat Source Unit
7 Refrigerant Vessel
8 Compressor
9 Oil Separator
25 Electrical Component Box
40 Casing
51 Bottom Frame
51*a* First Bottom Frame
51*b* Second Bottom Frame
52*a*, 52*b* Ridge Portions
53*a*, 53*b* Furrow Portions

CITATION LIST

Patent Literature

Patent Document 1: JP-A No. 2011-158137

The invention claimed is:

1. A heat source unit comprising:

a compressor;

an accumulator that accumulates refrigerant;

an oil separator that separates refrigerating machine oil from the refrigerant after the refrigerant has been discharged from the compressor; and an electrical component box, wherein the compressor, the accumulator, the oil separator, and the electrical component box are all disposed inside a casing, a bottom frame forming a bottom surface of the casing comprises:

a first bottom frame on which an entirety of the compressor, the accumulator, and the oil separator is disposed; and a second bottom frame that is adjacent to the first bottom frame, at least half of the electrical component box is placed above the second bottom frame, and a strength of the first bottom frame is greater than a strength of the second bottom frame.

2. The heat source unit according to claim 1, wherein the first bottom frame and the second bottom frame are adjacent in a right and left direction when the casing is viewed from a front surface side of the casing.

3. The heat source unit according to claim 1, wherein the electrical component box has a shape of a vertically long box in a state in which the electrical component box is disposed inside the casing.

4. The heat source unit according to claim 1, wherein the electrical component box is disposed on the second bottom frame.

5. The heat source unit according to claim 1, wherein the first bottom frame and the second bottom frame are corrugated plate-like members comprising ridge portions and furrow portions extending across the front and rear direction of the casing.

6. The heat source unit according to claim 1, wherein the thickness of the first bottom frame is greater than the thickness of the second bottom frame.

* * * * *